US006196653B1

(12) United States Patent
Igarashi et al.

(10) Patent No.: US 6,196,653 B1
(45) Date of Patent: Mar. 6, 2001

(54) INK JET PRINTER

(75) Inventors: Hiroshi Igarashi; Hiroo Ogawa; Makoto Ishii, all of Nagoya; Hiroshi Tokuda, Anjo; Shinji Kimura, Kani; Takashi Nakata, Nisshin, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/108,250

(22) Filed: Jul. 1, 1998

(30) Foreign Application Priority Data

Jul. 2, 1997 (JP) ..... 9-176915

(51) Int. Cl.[7] ..... B41J 2/165
(52) U.S. Cl. ..... 347/23; 347/32
(58) Field of Search ..... 347/23, 32, 22, 347/21, 33, 30, 35, 105

(56) References Cited

U.S. PATENT DOCUMENTS 4,870,430 * 9/1989 Daggett et al. ..... 347/88
5,148,203 * 9/1992 Hirano ..... 346/139 R
5,793,399 * 8/1998 Kawakami et al. ..... 347/104
6,030,073 * 2/2000 Coiner et al. ..... 347/84

FOREIGN PATENT DOCUMENTS

0714775A2 * 6/1996 (EP) ..... 347/35
403151247A * 6/1991 (JP) ..... 347/35

* cited by examiner

*Primary Examiner*—N. Le
*Assistant Examiner*—Shih-wen Hsieh
(74) *Attorney, Agent, or Firm*—Oliff & Beridge, PLC

(57) ABSTRACT

An ink jet printer includes a print head having ink nozzles, which is movable in a direction across the feeding path. A supply mechanism is provided at one side of the feeding path, which supplies ink to the print head located in the ink supply station. A maintenance mechanism is provided at the other side of the feeding path, which operates a predetermined operation. The ink jet printer is further provided with a first clutch which transmits the rotation of the actuator to the supply mechanism only when the print head is located in the above-mentioned one side, and a second clutch which transmits the rotation of the actuator to the maintenance mechanism only when the print head is located in the above-mentioned the other side. With this, the supply mechanism and the maintenance mechanism are actuated by a common actuator.

25 Claims, 14 Drawing Sheets

INK JET PRINTER

BACKGROUND OF THE INVENTION

This invention relates to an ink jet printer.

Generally, an ink jet printer uses an ink which is solid at a room temperature and which is molten when heated. In such an ink jet printer, a print head has ink nozzles through which ink droplets are emerged to a recording media such as a paper. Further, the print head has a hopper for storing the solid ink in the shape of pellets therein. The hopper is provided with a heater for melting the ink pellets stored in the hopper. The print head is movable in a direction perpendicular to a feeding path of the recording media.

In order to supply ink pellets to the print head, a supply station is provided at one side of the feeding path of the recording media. On supplying ink pellets to the print head, the print head moves to the supply station, where the ink pellets are supplied to the print head by means of a supply mechanism.

In order to prevent the clogging of the ink nozzles and to remove contamination of the ink nozzles, a maintenance station is provided to the other side of the feeding path of the recording media. When the print head moves to the maintenance station, a maintenance mechanism feeds a dummy sheet, so that the print head is able to emerge ink droplets to the dummy sheet.

However, since the supply mechanism and the maintenance mechanism are actuated by separate actuators, the cost of the ink jet printer is relatively high. Since the supply mechanism and the maintenance mechanism are not used at the same time, there is a strong demand for an ink jet printer in which a supply mechanism and a maintenance mechanism are actuated by a common actuator.

SUMMARY OF THE INVENTION

It is therefore an object of the present invention to provide an ink jet printer in which a supply mechanism and a maintenance mechanism are actuated by a common actuator.

According to an aspect of the present invention, there is provided an ink jet printer including a feeder which feeds a recording media along a feeding path, a print head (having ink nozzles) movable in a direction across the feeding path, a supply station in which the print head is provided with ink be means of a supply mechanism, a maintenance station in which a predetermined operation is performed on the print head by means of the maintenance mechanism, an actuator, a first clutch which transmits the power of the actuator to the supply mechanism only when the print head is located in the supply station, and a second clutch which transmits the power of the actuator to the maintenance mechanism only when the print head is located in the maintenance station.

As constructed above, the supply mechanism and the maintenance mechanism are actuated by the same actuator. Thus, the number of actuators can be reduced, so that the manufacturing cost of the ink jet printer can be reduced.

In a preferred embodiment, the supply station and the maintenance station are located outside of the feeding path of the recording media. Particularly, the supply station are provided at one side of the feeding path, while the maintenance station is provided at the other side of the feeding path.

In a particular arrangement, the first clutch is connected due to the movement of the print head when the print head moves into the supply station. Further, the first clutch is disconnected due to the movement of the print head when the print head moves out of the supply station. Since the first clutch is connected/disconnected by the movement of the print head, the control system becomes simple.

In a particular case, the first clutch includes a drive member linked to the actuator and a driven member linked to the supply mechanism. The drive member is moved with respect to the driven member in response to the movement of the print head, so that the drive member and the driven member selectively engage and disengage with each other. With this, the first clutch can be connected/disconnected in a simple manner.

Conveniently, the first clutch further includes a biasing member which biases the drive member in a direction toward the driven member, when the print head is located in the supply station. Thus, the engagement of the drive member and the driven member is maintained.

Advantageously, the biasing member biases the drive member in a direction away from the driven member, when the print head is located out of the supply station. With this, once the print head moves out of the supply station, the unintentional engagement of the drive member and the driven member is prevented.

In another particular arrangement, the second clutch is connected due to the movement of the print head when the print head moves into the maintenance station. Further, the second clutch is disconnected due to the movement of the print head when the print head moves out of the maintenance station. Since the second clutch is connected/disconnected by the movement of the print head, the control system becomes simple.

In a particular case, the second unit including a planetary gear unit (including a central gear, a pinion meshing with the central gear and a rotatable arm supporting the pinion), a drive gear linked to the actuator and meshing the central gear, a driven gear linked to the maintenance mechanism, and an urging mechanism which urges the rotatable arm. The urging mechanism urges the rotatable arm to disable a meshing of the pinion and the driven gear when the print head is located out of the maintenance station. The urging mechanism does not urge the rotatable arm when the print head is located in the maintenance station. Thus, the second clutch can be connected/disconnected in a simple manner. It is preferred to provide a contact lever which is to be pushed by the print head and which is linked to the urging mechanism.

In a development of the invention, the feeder is actuated by the actuator. Since the feeder is actuated by the actuator as well as the supply mechanism and the maintenance mechanism, the number of actuators can be further reduced. Accordingly, the manufacturing cost of the ink jet printer can be further reduced.

In one case, the actuator is able to rotate in two directions. The feeder is driven by a rotation of the actuator of one direction. The maintenance mechanism is driven by a rotation of the actuator of the other direction. Further, the supply mechanism is driven by a rotation of the actuator of one direction and by a rotation of the actuator of the other direction.

In a preferred embodiment, the ink is obtained by melting solid pellets. In such case, the supply mechanism is arranged to supply the solid pellets to the print head. Since the ink is supplied (to the print head) in the form of pellets, the arrangement for supplying the ink becomes simple.

Further, in the maintenance station, the maintenance mechanism feeds a sheet so that the print head is able to emerge ink droplets on the sheet. With this, it is possible to prevent the clogging of the nozzle and to remove contamination from the nozzle.

In another aspect of the present invention, there is provided a feeder which feeds a recording media along a feeding path, a print head movable in a direction across the feeding path, a supply mechanism (provided at one side of the feeding path) which supplies ink to the print head, a maintenance mechanism (provided at the other side of the feeding path) which operates a predetermined operation, a first clutch which transmits the power of the actuator to the supply mechanism only when the print head is located in the above-mentioned one side, and a second clutch which transmits the power of the actuator to the maintenance mechanism only when the print head is located in the above-mentioned other side.

DESCRIPTION OF THE PREFERRED EMBODIMENT

The embodiment of the present invention is described with reference to the drawings.

Figure 1:
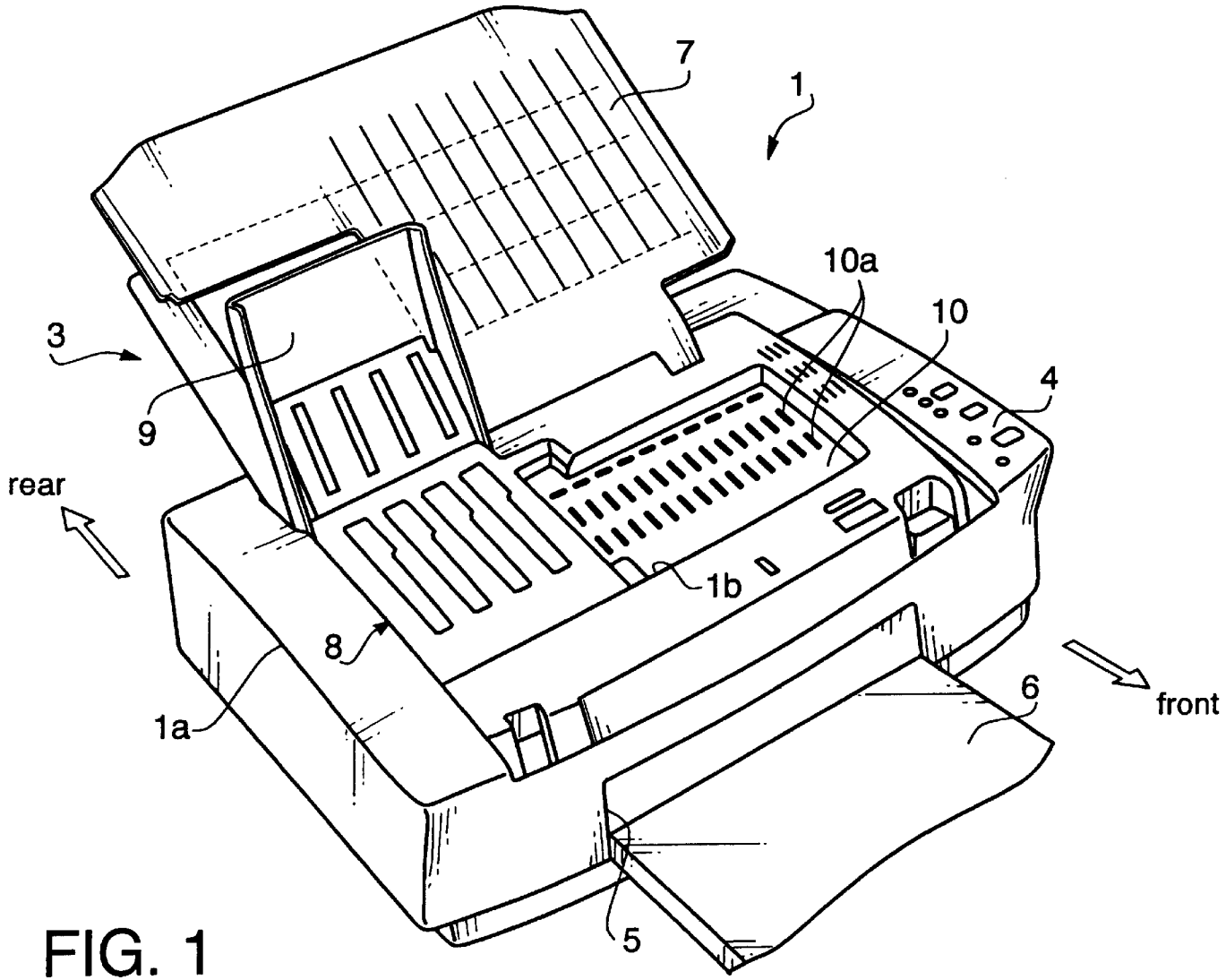
FIG. 1 is a perspective view of an ink jet printer according to an embodiment of the present invention.
Figure 2:
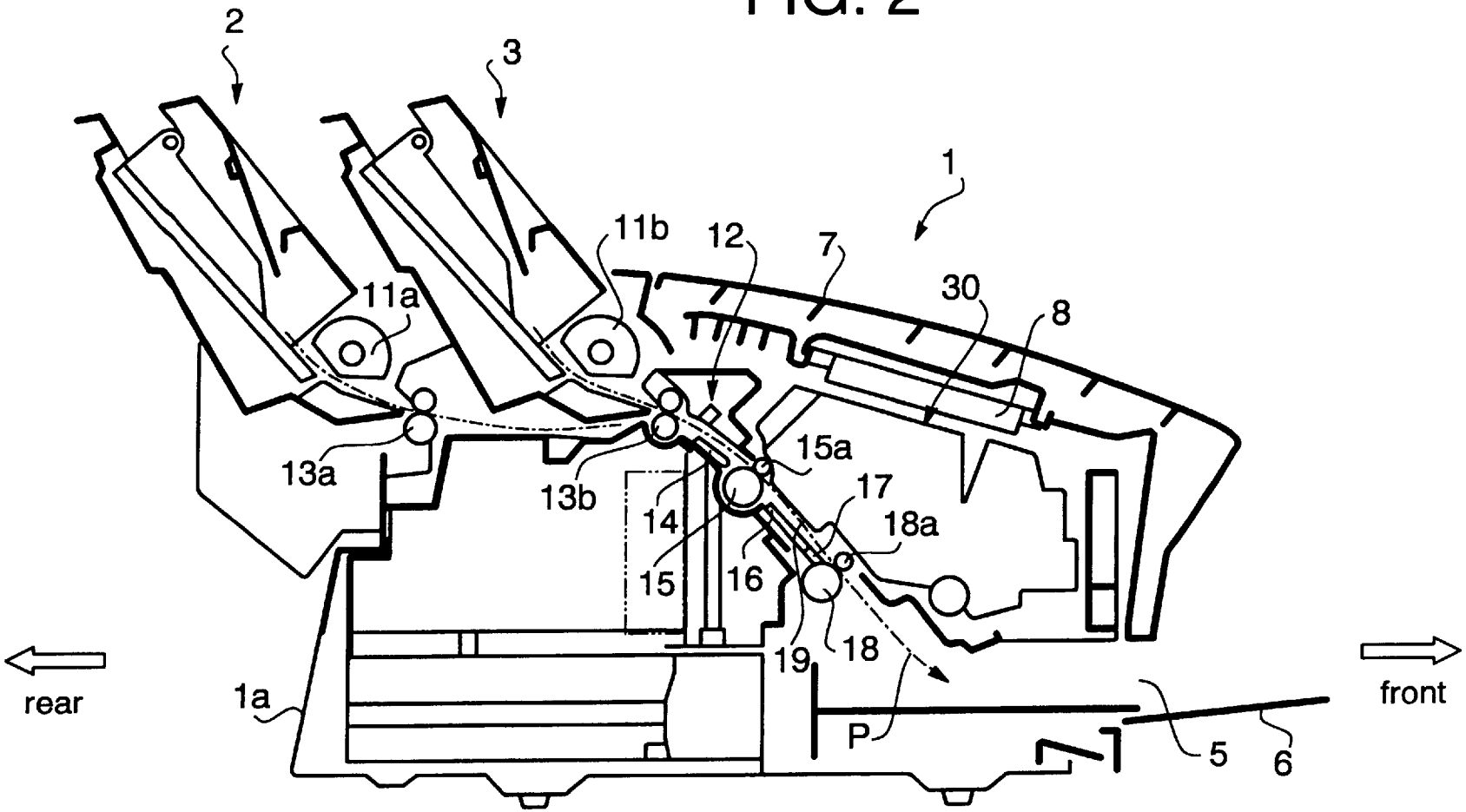
FIG. 2 is a sectional view showing an internal structure of the ink jet printer of FIG. 1.

FIGS. 1 and 2 are a perspective view and a sectional view of an ink jet printer 1 according to the embodiment. As shown in FIGS. 1 and 2, the ink jet printer 1 includes a casing 1*a*. Two sheet cassettes 2 and 3 are detachably mounted to one end of the casing 1*a*, respectively accommodating cut papers and OHP films. An discharge opening 5 is provided to the other end of the casing 1*a*. A tray 6 is detachably mounted to the discharge opening 5, which receives a recording sheet (such as cut papers and OHP films) discharged from the discharge opening 5.

Hereinafter, a discharge opening side of the printer 1 is referred to as 'front', while a cassette side of the printer 1 is referred to as 'rear'.

As shown in FIG. 1, the casing 1*a* has a center opening 1*b* at the top portion thereof. The center opening 1*b* is covered by a swingable cover 7. An ink case 8 is mounted to a left part of the center opening 1*b*. The ink case 8 accommodates ink pellets 22 (FIG. 5A) of yellow, magenta, cyan, and black. The ink case 8 has a swingable cover 9 which covers the top thereof. A right part of the center opening 1*b* is covered by a transparent cover 10 having multiple of ventilation holes 10*a*.

As shown in FIG. 2, a feeding path is formed between the sheet cassettes 2 and 3 and the discharge opening 5. In order to introduce the recording sheets of the sheet cassette 2 and 3, two hemicircular rollers 11*a* and 11*b* are provided at cassette mounting portions of the printer 1. The hemicircular roller 11*a* is so constituted that an arc surface thereof contacts a top sheet of the stacked recording sheet. That is, the recording sheet of the cassette 2 is introduced into the feeding path by one rotation of the hemicircular roller 11*a*. Similarly, the recording sheet of the cassette 3 is introduced into the feeding path by one rotation of the hemicircular roller 11*b*.

Figure 7:
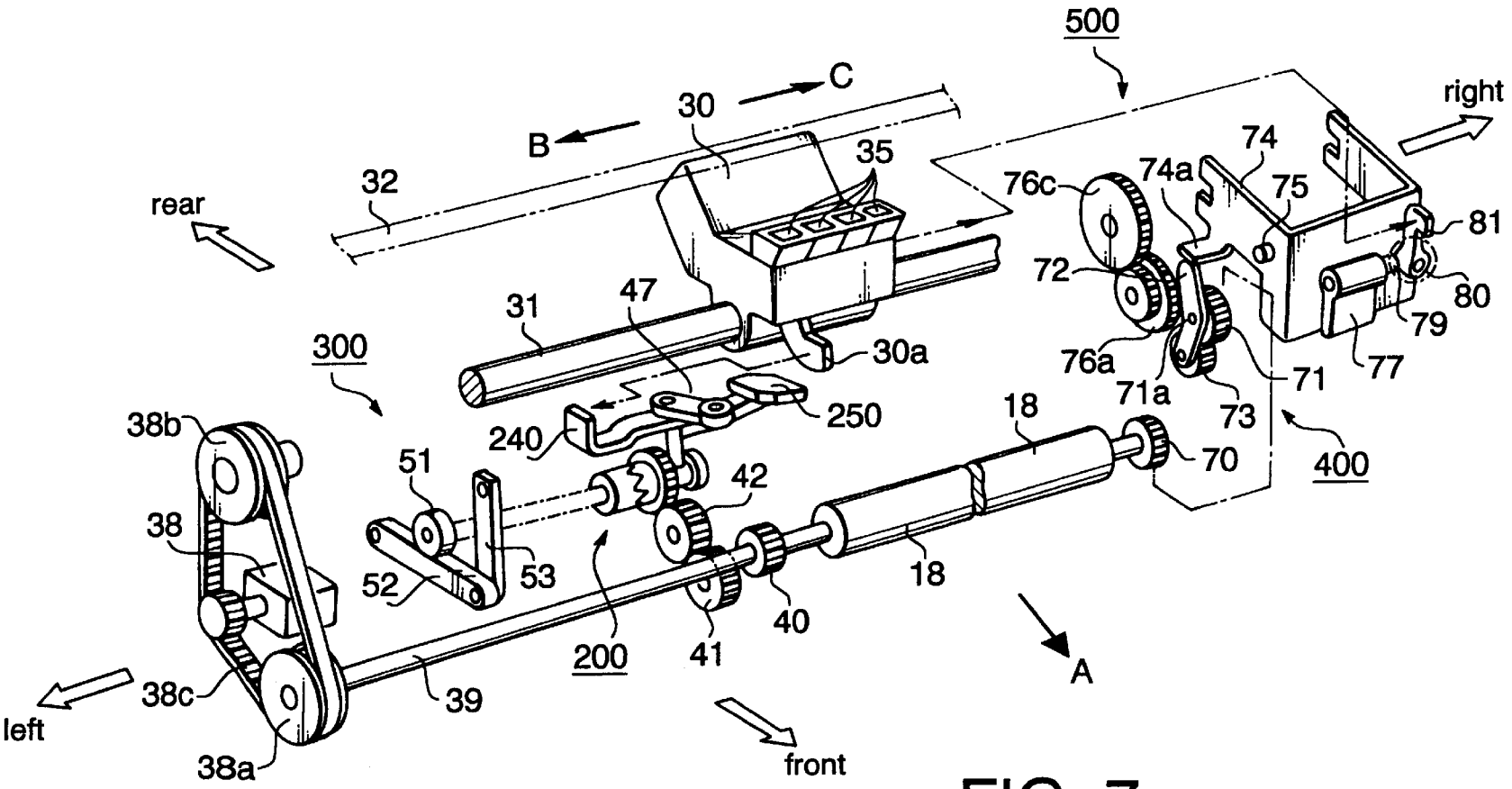
FIG. 7 is an exploded perspective view of a main driving mechanism of the ink jet printer of FIG. 1.

A resist roller pair 13*a* and 13*b*, a pre-heat platen 14, a feed roller 15, a main platen 16, a cooling platen 17, and a discharge roller 18 are disposed along the feeding path. The feed roller 15 and the discharge roller 18 are actuated by a main motor 38 (FIG. 7). Further, pinch rollers 15*a* and 18*a* are provided for urging the recording sheet to the feed roller 15 and the discharge roller 18, respectively. As the recording sheet proceeds through the pre-heat platen 14 and main platen 16, the recording sheet is gradually heated by the pre-heat platen 14 and main platen 16.

A print head 30 has ink nozzles 19 which are faced with the main platen 16 with the recording sheet interposed therebetween. The print head 30 uses an ink which is solid at room temperature. The print head 30 has a not shown heater for melting the ink pellets and an ink tank for storing molten ink. The print head 30 emerges ink droplets through the ink nozzles 19 onto the recording sheet. As the recording sheet passes through the cooling platen 17, the ink applied on the recording sheet is cooled and solidified. The solidification of ink is completed before reaching the discharge roller 18. With this, an image is formed on the recording sheet, and the recording sheet is discharged from the discharge opening 5.

Figure 3:
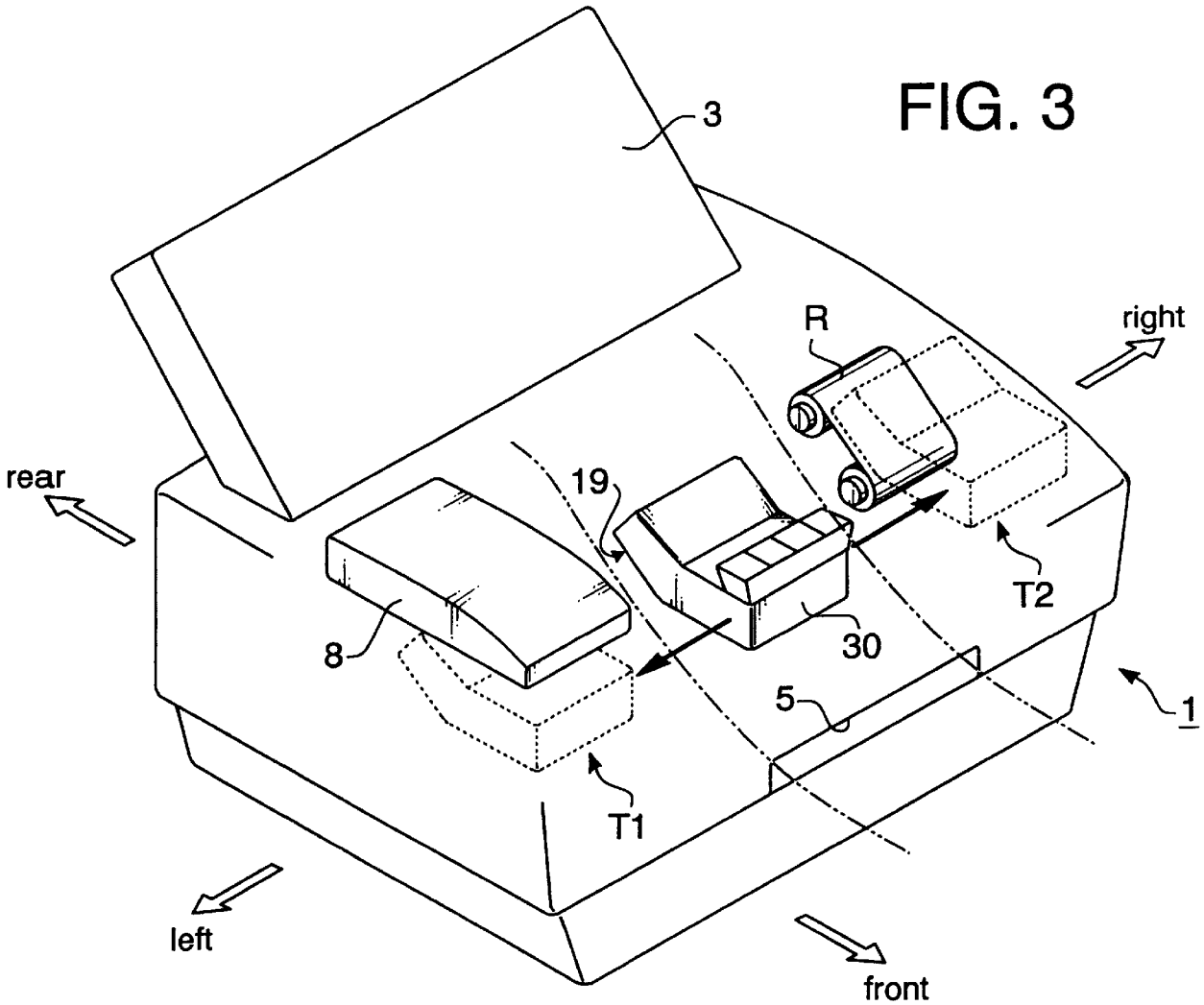
FIG. 3 is a schematic view illustrating a moving range of a print head.
Figure 4:
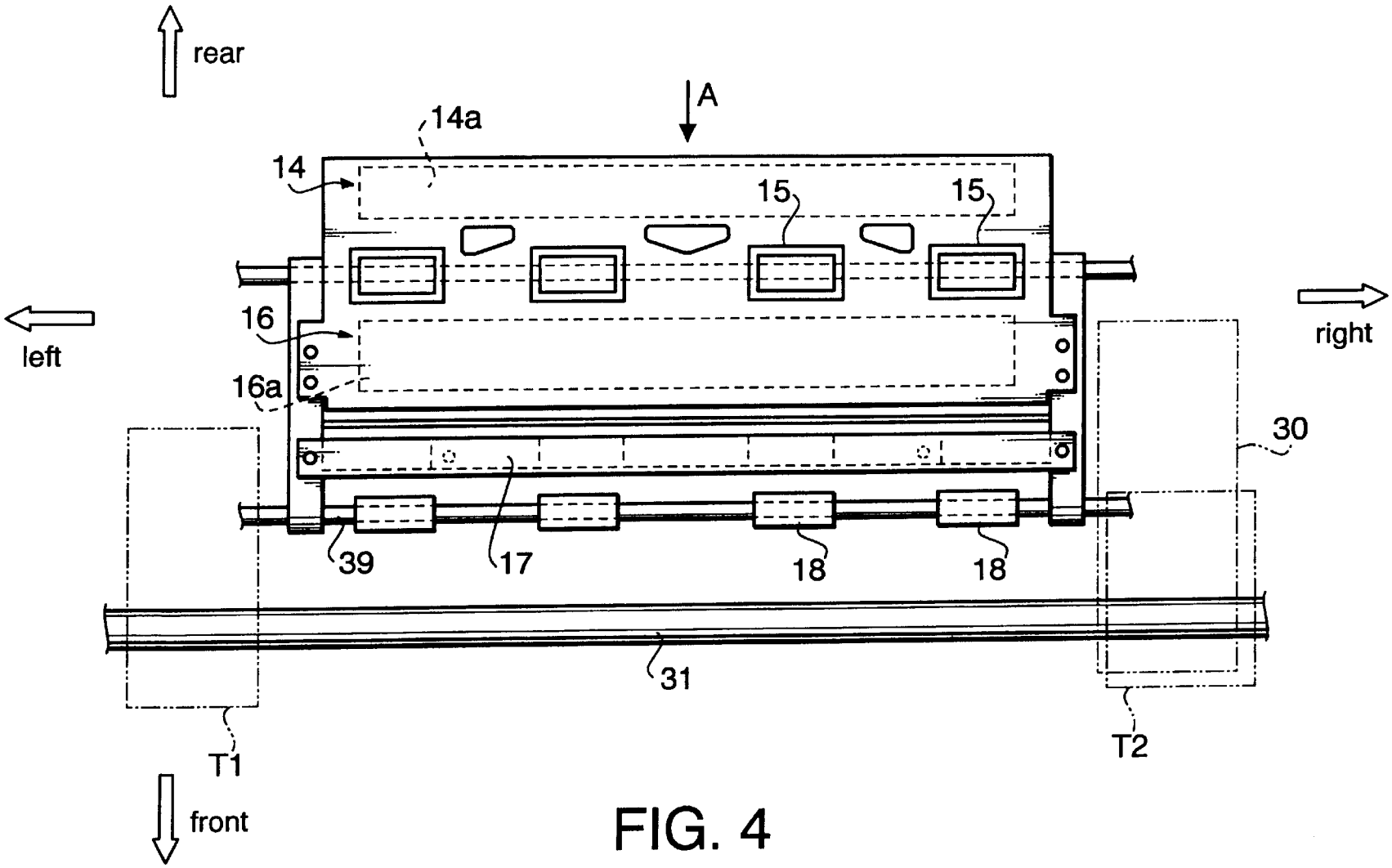
FIG. 4 is a plan view illustrating a moving range of the print head.

FIGS. 3 and 4 are schematic views illustrating a moving range of the print head 30. The print head 30 is movable (by a not-shown head moving mechanism) across the feeding path of the recording sheet. The print head 30 is laterally guided by a roller shaft 31 (FIG. 4). The print head 30 is moved in synchronization with the feeding of the recording sheet 1 so that a two dimensional image is formed on the recording sheet 1.

The printer 1 includes a supply station T1 located at the left side of the feeding path and a maintenance station T2 located at the right side of the feeding path. When the print head 30 moves to the supply station T1, ink pellets accommodated in an ink case 8 are supplied to the print head 30. When the print head 30 moves to the maintenance station T2, the print head 30 emerges ink droplets to a roll sheet R, so as to prevent clogging of the ink nozzles 19 and to remove contamination from the ink nozzles 19.

Figure 5A:
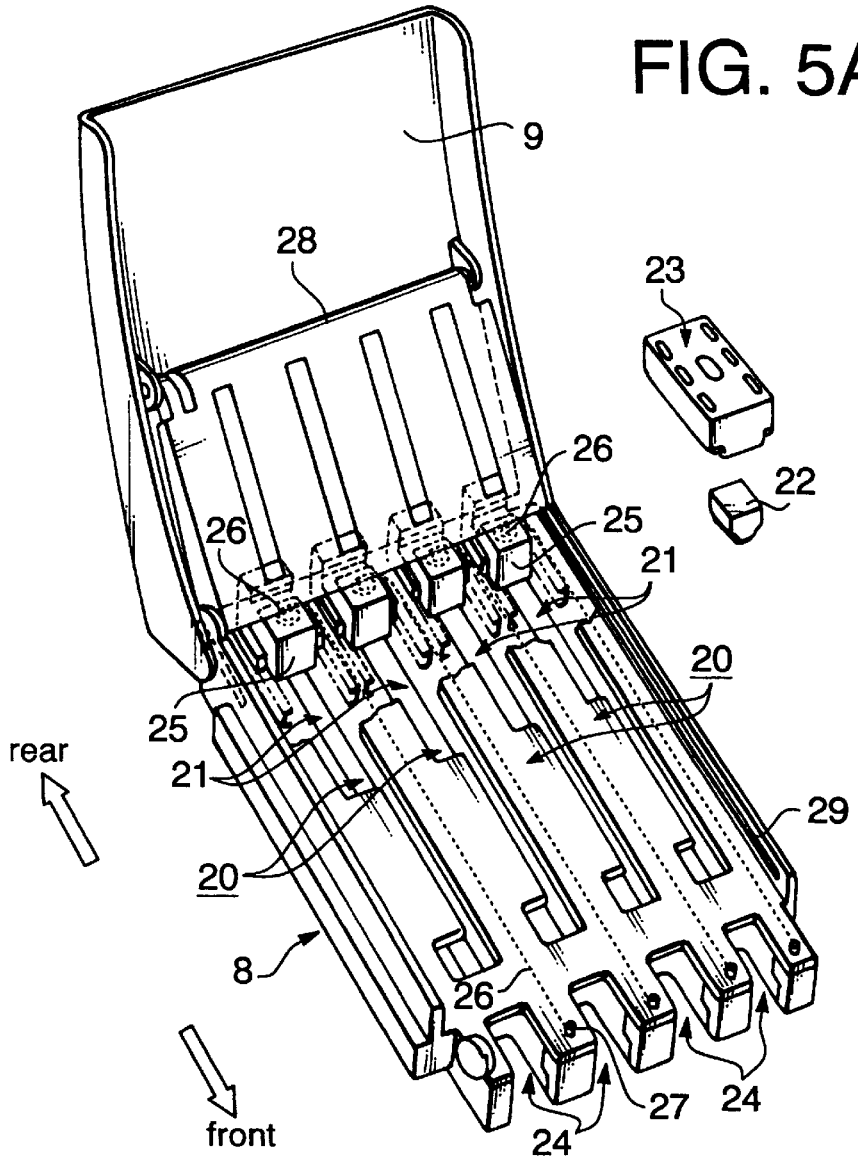
FIGS. 5A and 5B are a perspective view of an ink case and an enlarged view of an exit opening of the ink case.

The structure of the ink case 8 is described. FIG. 5A is a perspective view of the ink case 8. Ink pellets 22 are housed in an ink cartridge 23. The ink cartridge 23 has an opening (not shown) at a bottom thereof. When an operator grips a body of the ink cartridge 23 on front and rear sides, the ink pellets are released from the ink cartridge 23. The ink case 8 has four grooves 20 for accommodating ink pellets 22 of four colors (Yellow, Magenta, Cyan and Black) therein. Each groove 20 has a channel 21 on which pellets 22 are aligned.

Four exit openings 24 are formed at the front ends of the grooves 20. In order to urge the pellets 22 toward the exit openings 24, four slide blocks 25 are provided in the grooves 21. The slide blocks 25 are slidable in the grooves 21, guided by both side walls of the grooves 21. Each slide block 25 is urged frontward by a helix spring 26. One end of the helix spring 26 is fixed to a pin 27 planted on the front end of the ink case 8, while the other end of the helix spring 26 is fixed to the slide block 25. Due to the force of the helix springs 26, the slide blocks 25 urge the pellets 22 to the exit openings 24. In order to retract the slide blocks 25 rearward, a link plate 28 is provided. One end of the link plate 28 is pivotably connected to the center portion of the cover 9, while the other end of the link plate 28 is slidably guided by guide grooves 29 formed on both lateral side walls of the ink case 8. When the cover 9 is opened as shown in FIG. 5, the slidable end of the link plate 28 is moved to the rear end of the ink case 8. The slidable end of the link plate 28 drags the slide blocks 25, so that the slide blocks 25 are retracted to the rear end of the grooves 25. In this state, it is possible to set additional ink pellets 22 to the grooves 20.

Figure 5B:
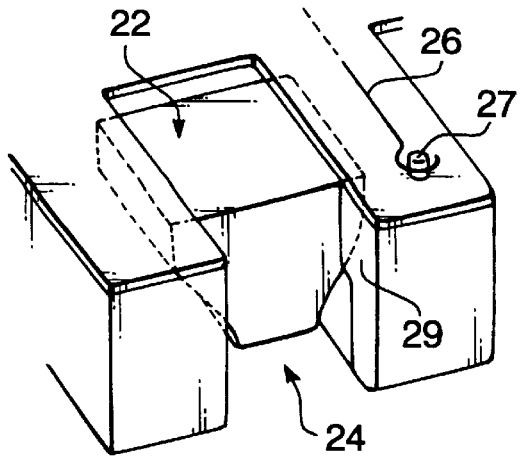
Figure 11:
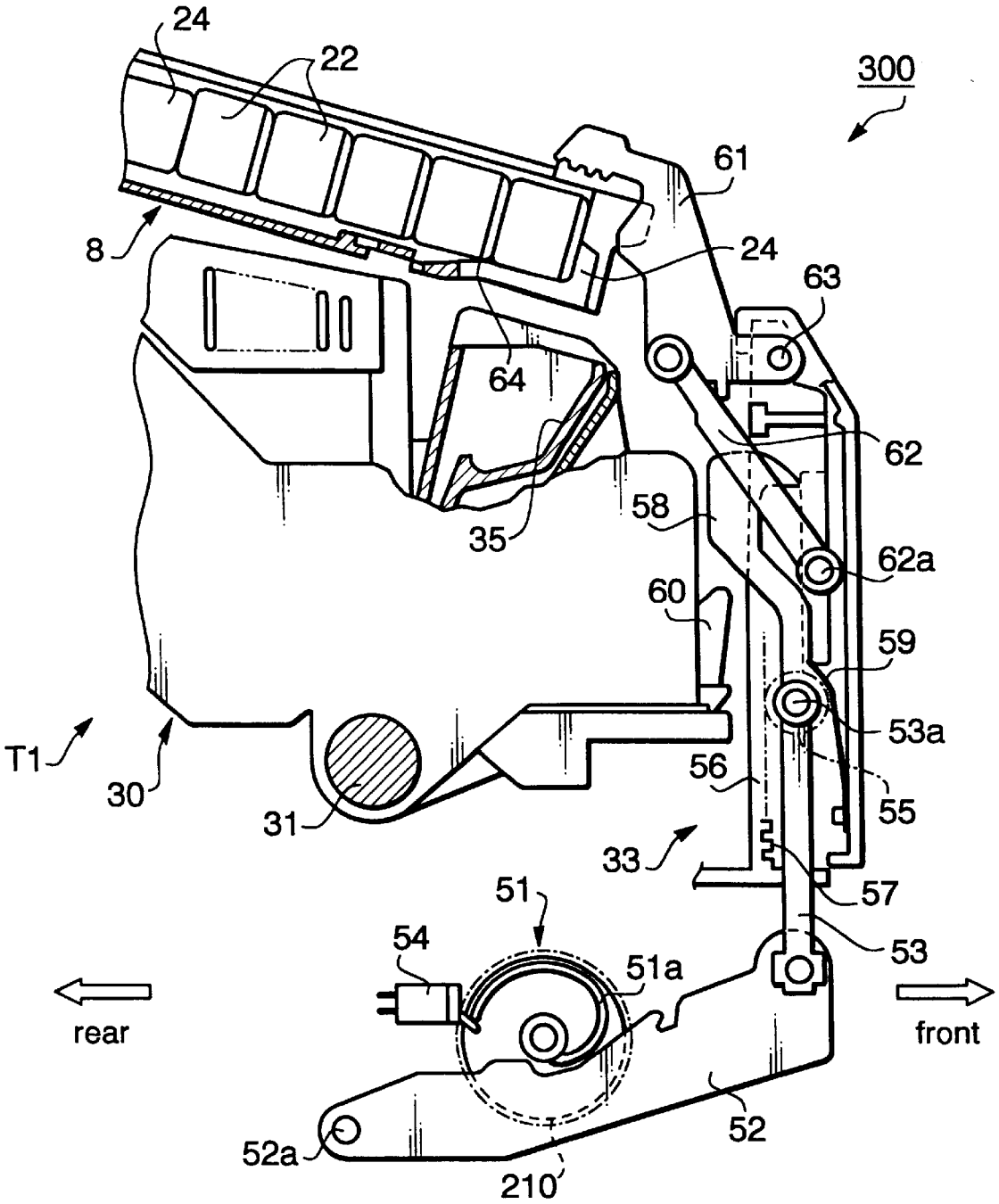
FIG. 11 is a side view of a supply mechanism of the embodiment.

FIG. 5B is an enlarged view showing the exit opening 24 of the ink case 8. A stopper 29 is provided to the front end of the exit opening 24. The stopper 29 abuts both lateral ends of the front surface of the pellet 22, so that the pellet 22 does not drop out of the exit opening 24. In the exit opening 24, the bottom of the pellet 22 is supported by a bendable plate 64 (FIG. 11).

Figure 6A:
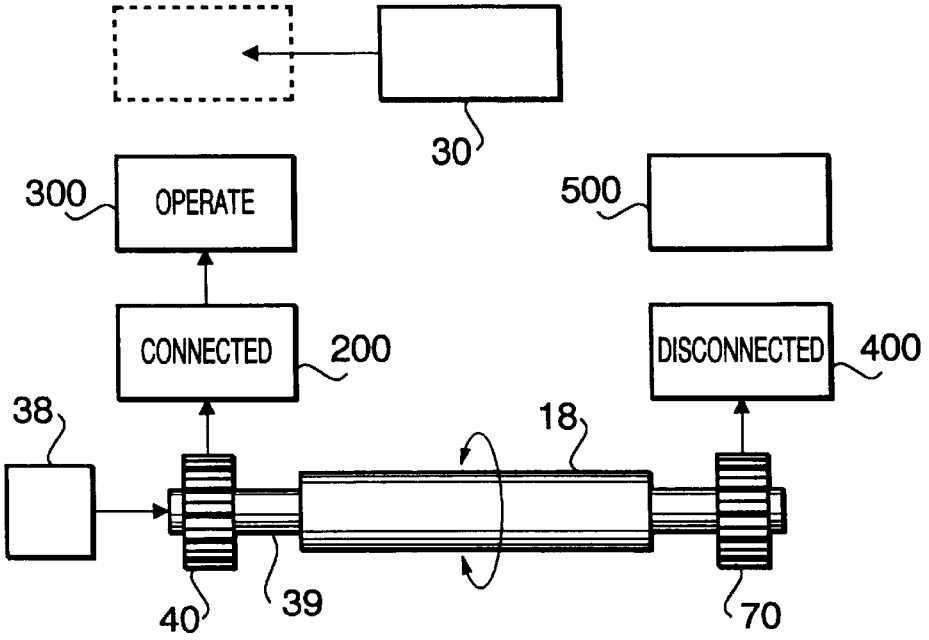
FIGS. 6A and 6B are schematic views showing a concept of clutches of to the embodiment.
Figure 6B:
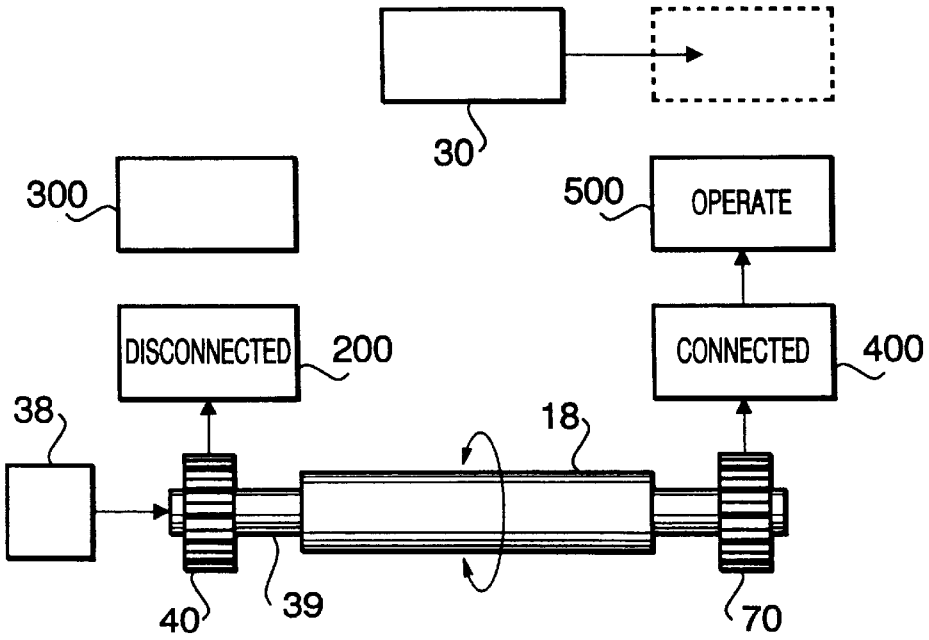

FIGS. 6A and 6B are schematic views illustrating a concept of an arrangement for selectively driving a supply mechanism 300 and a maintenance mechanism 500. The supply mechanism 300 supplies ink pellets to the print head 30. The maintenance mechanism 500 performs a predetermined operation to prevent a clogging of the ink nozzles 19. A main motor 38 is linked to a main shaft 39 on which the above-described discharge roller 18 is provided. In order to transmit the rotation of the main shaft 39 to the supply mechanism 300 and the maintenance mechanism 500, first and second transmission gears 40 and 70 are provided to the shaft 39. The transmission gears 40 and 70 are located at both sides of the discharge roller 18. A first clutch 200 is provided between the transmission gear 40 and the supply mechanism 300. A second clutch 400 is provided between the transmission gear 70 and the maintenance mechanism 500. The first clutch 200 is connected only when the print head 30 is located in the supply station T1 as shown in FIG. 6A. The second clutch 400 is connected only when the print head 30 is located in the maintenance station T2 as shown in FIG. 6B.

FIG. 7 is an exploded perspective view illustrating the detailed arrangement of FIG. 6. The main motor 38 is able to rotate clockwise and counterclockwise in FIG. 7. The main motor 38 drives pulleys 38*a* and 38*b* via a timing belt 38*c*, thereby to rotate the shaft 39 (to which the pulley 38*a* is fixed). When the motor 38 is rotated clockwise, the discharge roller 18 rotates clockwise so that the recording sheet is fed in the direction shown by an arrow A. The rotation of the transmission gear 40 is transmitted to the first clutch 200 via two intermediate gears 41 and 42.

Figure 8:
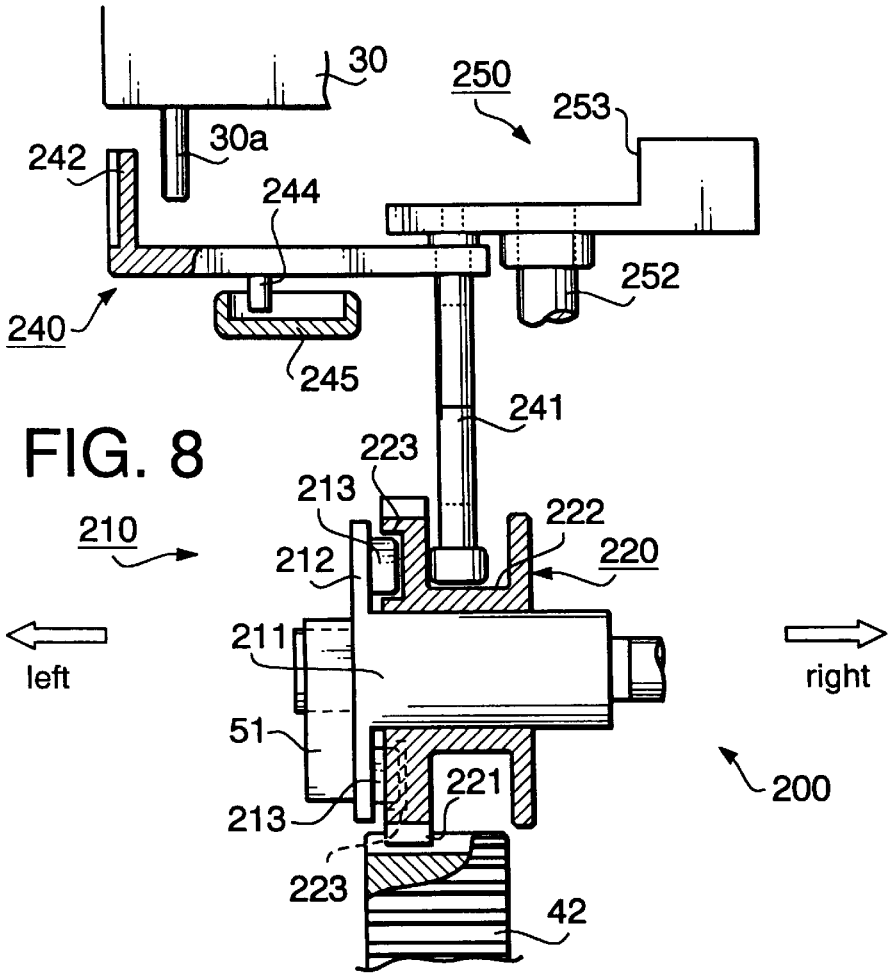
FIG. 8 is a front view of a first clutch of the embodiment.

FIG. 8 is an enlarged front view of the first clutch 200. The first clutch 200 includes a driven ring 210 which has a cam 51 (detailed below) for driving the supplying mechanism 300. The driven ring 210 has a sleeve portion 211 and a flange portion 212. A drive ring 220 is provided around the sleeve portion 211 of the driven ring 210 so that the drive ring 220 is slidable on an outer surface of the sleeve portion 211 in axial and rotational directions. The drive ring 220 includes a peripheral gear 221 which engages the intermediate gear 42.

Figure 9:
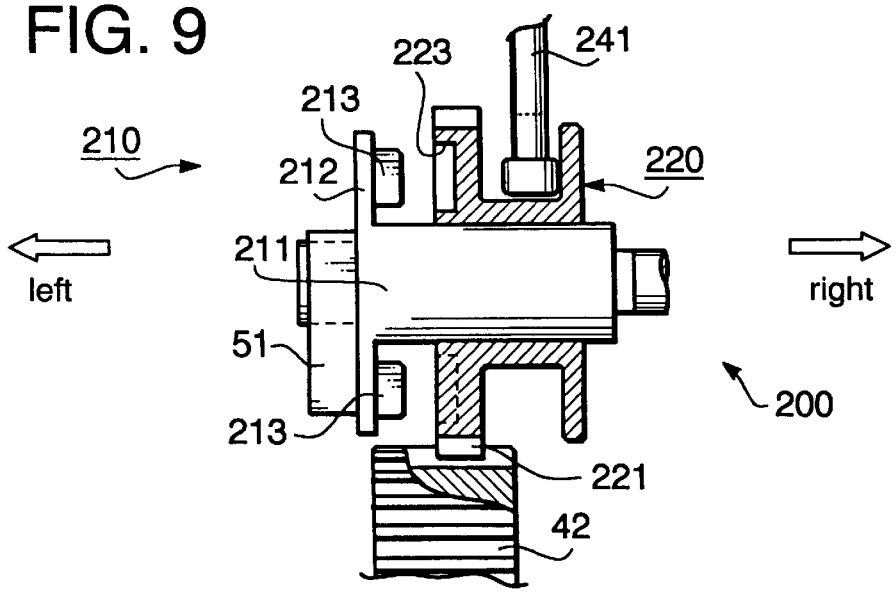
FIG. 9 is a front view of the first clutch of FIG. 8 showing a movement of a drive ring.

Bosses 213 and holes 223 are formed on mating surfaces of the driven ring 210 and the drive ring 220, respectively. When the bosses 213 fit into holes 223, the driven ring 210 and the drive ring 220 are engaged. That is, the rotation of the drive ring 220 is transmitted to the driven ring 210. Thus, the first clutch 200 transmits the rotation of the gear 42 to the driven ring 210 (that is, to the cam 51). On the other hand, when the drive ring 220 is slid away from the flange portion 211 of the driven ring 210 as shown in FIG. 9, the rotation of the drive ring 220 is not transmitted to the driven ring 210. Thus, the first clutch 200 does not transmit the rotation of the gear 42 to the driven ring 210 (that is, to the cam 51).

A slider 240 is provided above the driven and drive rings 210 and 220. The slider 240 is slidably supported by a not-shown supporting member. The slider 240 has a pin 244 which engages a guide groove 245 extending in a lateral direction. With this, the slider 240 is slidable in the lateral direction by a certain amount. The slider 240 has a pin 241 extending downward, which engages a peripheral groove 222 formed on the drive ring 220. Further, the slider 240 has a contact plate 242 formed at the left end thereof. The contact plate 242 projects upward in a moving range of a pusher plate 30*a* provided at the bottom of the print head 30.

Figure 10A:
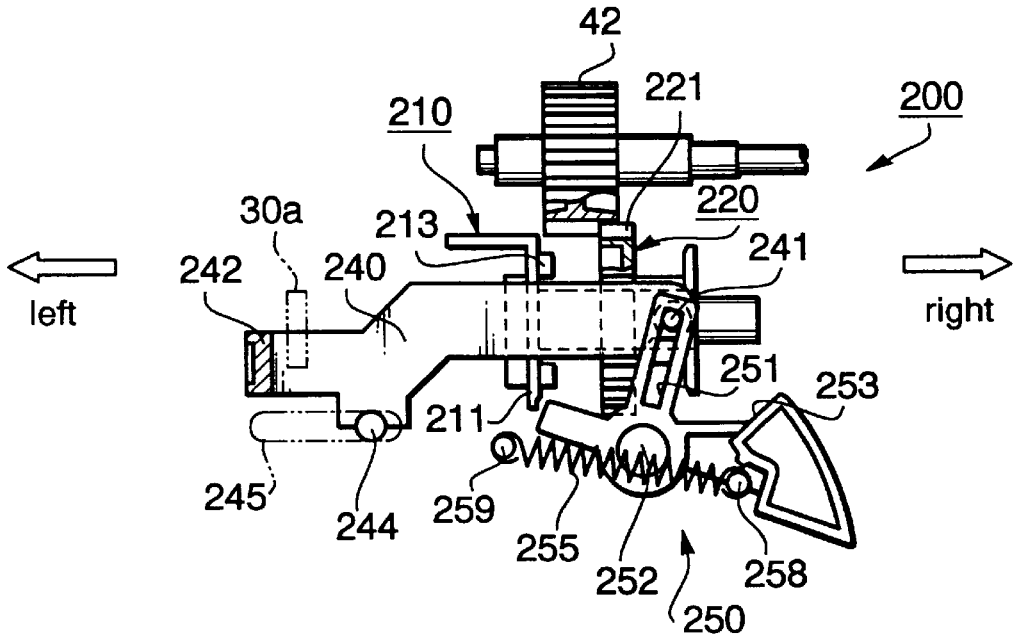
FIGS. 10A and 10B are plan views of the first clutch of FIG. 8.
Figure 10B:
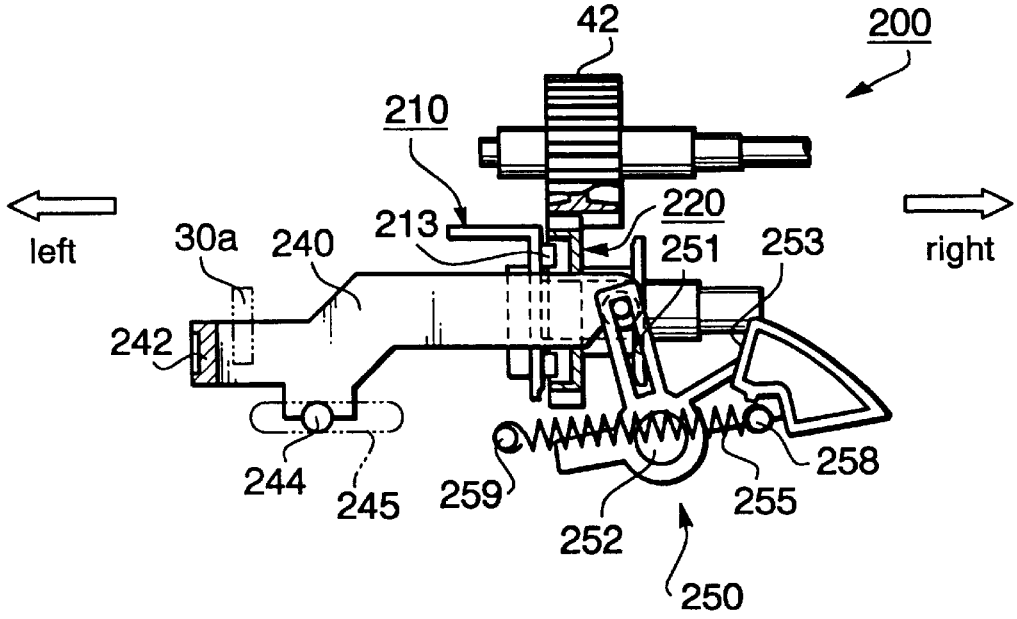

FIGS. 10A and 10*b* are plan views of the first clutch 200. A biasing lever 250 is provided above the slider 240. The biasing lever 250 is pivotably supported by a pivoting shaft 252 supported by a not-shown supporting member. The biasing lever 250 is linked to the slider 240 due to an engagement of a groove 251 formed on the biasing lever 250 and a pin 241 planted on the slider 240. As the slider 240 linearly moves, the biasing lever 250 is swung as shown in FIGS. 10A and 10B. In order to bias the slider 240, the biasing lever 250 is provided with a coil spring 255. One end of the coil spring 255 is fixed to a pin 258 planted on the slider 250, while the other end of the coil spring 255 is fixed to a pin 259 provided to a not-shown supporting member. When the slider 240 is positioned at its mid-position, the coil spring 255 is positioned on the pivoting shaft 252 of the biasing lever 250. Accordingly, the direction in which the biasing lever 250 biases the slider 240 is changed according to the position of the slider 240. Thus, the biasing lever 250 biases the slider 240 to the right when the slider 240 is positioned in the right half of its moving range as shown in FIG. 10A. In this state, the drive ring 220 and the driven ring 210 are disengaged. On the other hand, the biasing lever 250 biases the slider 240 to the left when the slider 240 is positioned in the left half of its moving range as shown in FIG. 10B. In this state, the drive ring 220 and the driven ring 210 are engaged with each other.

Further, the biasing lever 250 has a contact wall 253 which projects upward. The contact wall 253 extends into a moving range of the pusher plate 30a of the print head 30 as shown in FIG. 8. When the print head 30 moves to the right, the pusher plate 30*a* of the print head 30 pushes the contact wall 253 so that the biasing lever 250 is swing to the right as shown in FIG. 10A.

With such an arrangement, when the print head 30 moves to the left (that is, moves into the supply station T1), the pusher plate 30*a* of the print head 30 pushes the contact plate 242 to the left. With this, the slider 240 moves to the left as shown in FIG. 10B. Thus, the drive ring 220 and the driven ring 210 engage with each other. This state is maintained due to the biasing force the coil spring 255. On the other hand, when the print head 30 moves to the right (that is, moves out of the supply station T1), the pusher plate 30*a* of the print head 30 pushes the contact wall 253 to the right. With this, the swing lever 250 is swung to the right and therefore the slider 240 moves to the right as shown in FIG. 10A. Accordingly, the drive ring 220 and the driven ring 210 disengage with each other. This state is maintained due to the biasing force of the coil spring 255.

As constructed above, the first clutch 200 is connected when the print head 30 moves in the supply station T1, while the first clutch 200 is disconnected when the print head 30 moves out of the supply station T1. There is a possibility that the slider 240 (or biasing lever 250) is moved to the left by an unintentional vibration, even when the print head 30 is not located in the supply station T1. In such case, it is possible to move the slider 240 (or biasing lever 250) back to the right by moving the print head 30 once again.

Figure 12B:
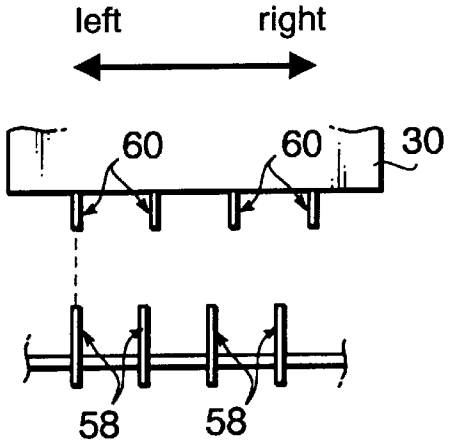
FIG. 12B is a schematic view showing a positional relationship between selector pins and hooks of the supply mechanism of FIG. 11.
Figure 12A:
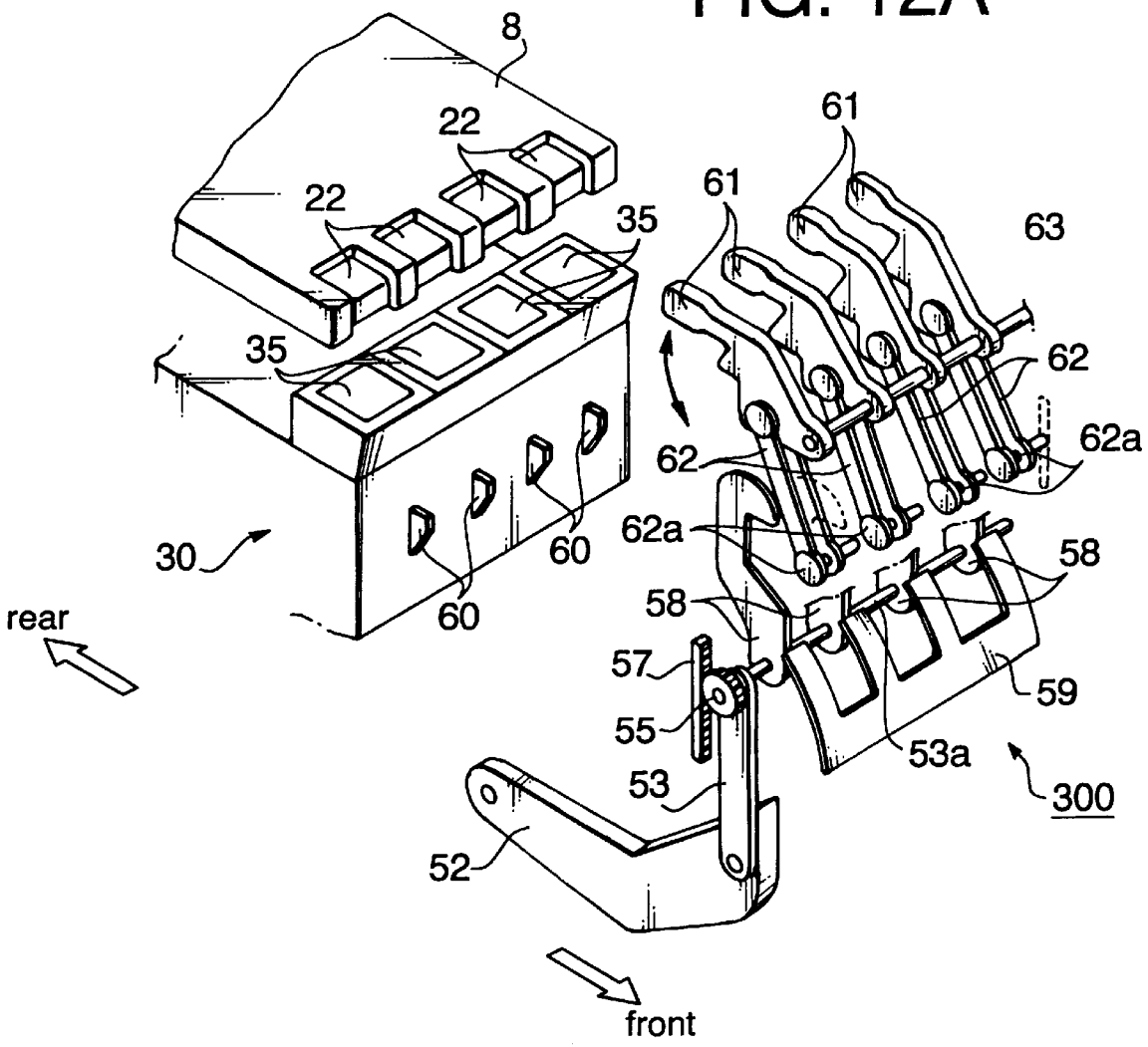
FIG. 12A is a perspective view of the supply mechanism of FIG. 11.

The supply mechanism 300 is described. FIGS. 11 and 12A are a side view and a perspective view showing the supply mechanism 300. As shown in FIG. 11, the ink case 8 is mounted at the top of the supply station T1. At the exit opening 24 of the ink case 8, the pellet 22 is supported by a bendable plate 64. The print head 30 has hoppers 35 for receiving the pellets 22 dropped from the ink case 8. The supply mechanism 300 includes a unit frame 56 located at the front side of the supply station T1.

A spiral cam 51 is provided on the surface of the above described driven ring 210. The position of the cam 51 is detected by a limit switch 54 located in the vicinity of the driven ring 210. The limit switch 54 is turned on when the cam 51 is at an initial rotational position as shown in FIG. 11. The supply mechanism 300 further includes a swing arm 52 which is vertically swingable. The swing arm 52 is urged by a not-shown spring so that the swing arm 52 contacts the cam 51. Due to the contact of the swing arm 52 and the cam 51, when the cam 51 rotates, the swing arm 52 vertically swings.

As shown in FIG. 12A, since the ink case 8 has four lines of pellets 22, the supply mechanism 300 includes four push levers 61 corresponding to respective lines of pellets 22. The push levers 61 are swingably supported by a top shaft 63, so that each push lever 61 is able to vertically swing. When the push lever 61 swings downward, the push lever 61 pushes the pellet 22 form above. Since the bendable plate 64 (FIG. 11) is easily bent, the pushed pellet 22 is dropped into the hopper 35 of the print head 30. Each push lever 61 is biased by a not-shown spring so that the push lever 61 normally does not swing downward. Each push lever 61 is connected to a first link 62. The upper end of the first link 62 is connected to the push lever 61, while the lower end 62*a* of the first link 62 is vertically guided by a not-shown guide member.

The supply mechanism 300 further includes four hooks 58 each of which is engagable with the lower end 62*a* of the link lever 62. The four hooks 58 are swingably supported by a hook shaft 53*a* held by a second link 53. A lower end of the second links 53 is connected to the swing arm 52. A pinion 55 is provided to an end of the hook shaft 53*a*. Further, the hook shafts 53*a* are urged by four plate springs 59 provided to the front side of the hook shafts 53*a*. Each hook 58 is urged rearward by the plate springs 59 so that the hook 58 does not engage the lower portion 62*a* normally (when not necessary). The pinion 55 is guided by a not shown guide rib so that the pinion 55 engages a rack 57 provided to the frame 56 (FIG. 11). With this, the hook shaft 53*a* vertically moves according to the swinging of the swing arm 52.

The color of the pellet 22 to be supplied is determined by the lateral movement of the print head 30. For this purpose, the print head 30 has four selector pins 60 corresponding to four ink color. FIG. 12B is a schematic view showing a positional relationship between the selector pins 60 and the hooks 58. The interval of the selector pins 60 is different from the interval of the hook 58. That is, when one of the selector pin 60 meets one hook 58, the other selector pins 60 meets no hook 58. In FIG. 12B, the left-most selector pin 60 meets the left-most hook 58, while other selector pins 60 meets no hooks 58.

The selector pin 60 which meets one of the hooks 58 urges the hook 58 frontward, When the hooks 58 moves downward. The hook 58 which is urged by the selector pin 60 is shifted frontward toward the link lever 62, so that the hook 58 engages the lower end 62*a* of the first link 62. Due to the engagement of the hook 58 and the lower end 62*a*, the push lever 61 swings downward. On the other hand, the hook 58 which is not urged by the selector pin 60 does not engages the first link 62. Accordingly, only the selected push lever 61 pushes the pellet 22, so that the pellet 22 of the selected color is dropped into the hopper 35 of the print head 35.

The operation of the supply mechanism 300 is described with reference to FIG. 11. First, the print head 30 is moved into the supply station T1 so that the print head 30 is located beneath the ink case 8. As described above, when the print head 30 moves in the supply station T1, the first clutch 200 (FIG. 10B) is connected. Then, in order to determine the color of pellet to be supplied, the print head 30 is laterally moved so that one of the selector pins 60 meets one of the hooks 58. Since this movement for selection is relatively small, the pusher pin 30*a* of the print head 30 does not abut the contact wall 253 (FIG. 10B), so that the clutch 200 is not disconnected.

A controller 100 (FIG. 15) checks if the limit switch 54 is ON to detect if the cam 51 is at its initial position. Then, the controller 100 drives the main motor 38 (FIG. 7) counterclockwise, so that the driven ring 210 (and the cam 51 formed thereon) rotates clockwise. When the cam 51 rotates clockwise by a predetermined angle less than 360°, the swing arm 52 swings downward, so that the second links 53, the hooks 58 and the first links 62 move downward. With this, the push lever 61 pushes the pellet 22 so that the ink pellet 22 drops into the hopper 35 of the print head 30. After the ink pellets 22 are supplied to the print head 30, the controller 100 drives the main motor 38 clockwise so that the cam 51 rotates counterclockwise by the predetermined angle. With this, the swing arm 52 swing upward to its original position. Accordingly, the second link 53, the hooks 58, the first links 62 and the push levers 61 are moved to their original positions shown in FIG. 11. As described above, when the print head 30 moves out of the supply station T1, the first clutch 200 is disconnected.

Figure 13:
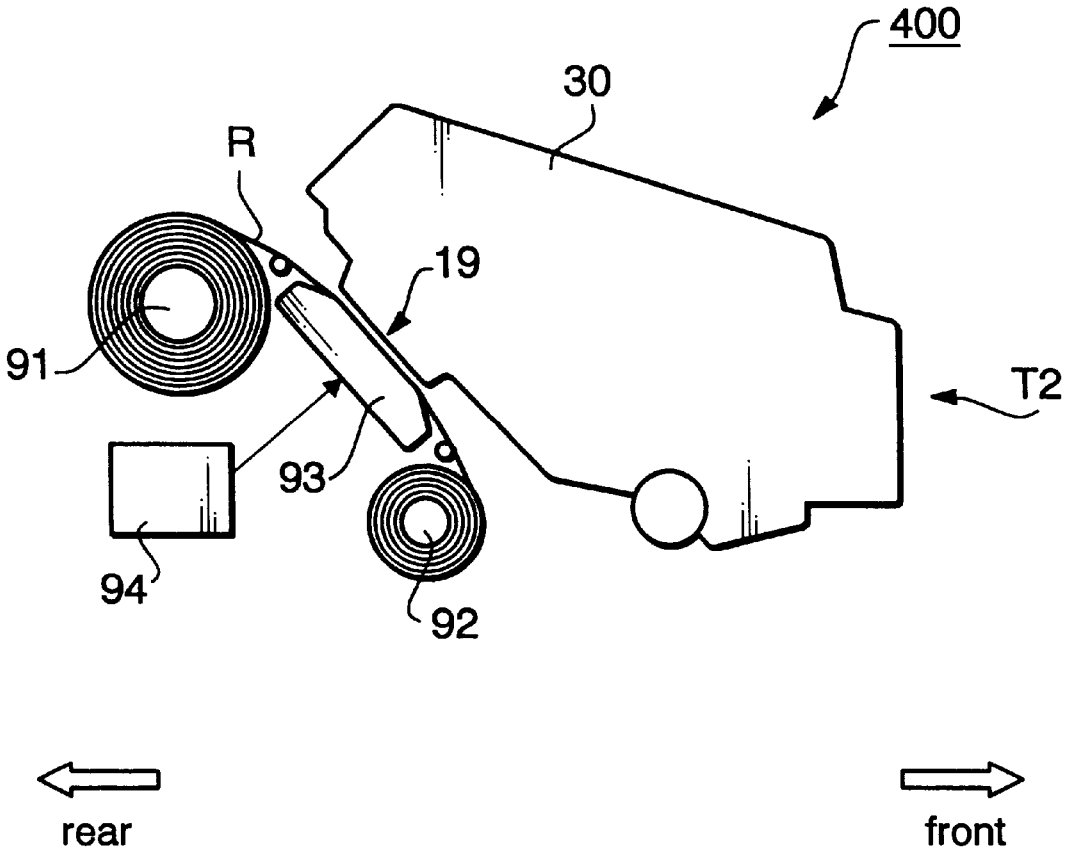
FIG. 13 is a schematic view showing a concept of a maintenance mechanism of the embodiment.

The maintenance mechanism 500 is described. FIG. 13 is as schematic view illustrating a concept of the maintenance mechanism 500. As shown in FIG. 13, two spools 91 and 92 are provided in the maintenance station T2, which carry a roll sheet R. The spool 91 is rotated so that the roll sheet R held on the spool 92 is wound up on the spool 91. In order to rotate the spool 91, the spool 91 has a spool gear 76*c* (FIG.

14). A movable platen 93 is provided between the spools 91 and 92. The platen 93 is moved toward and away from the ink nozzles 19 of the print head 30 by a platen moving mechanism 94. When the platen 93 is moved toward the ink nozzles 19, the roll sheet R is closely faced with the ink nozzles 19.

Figure 14:
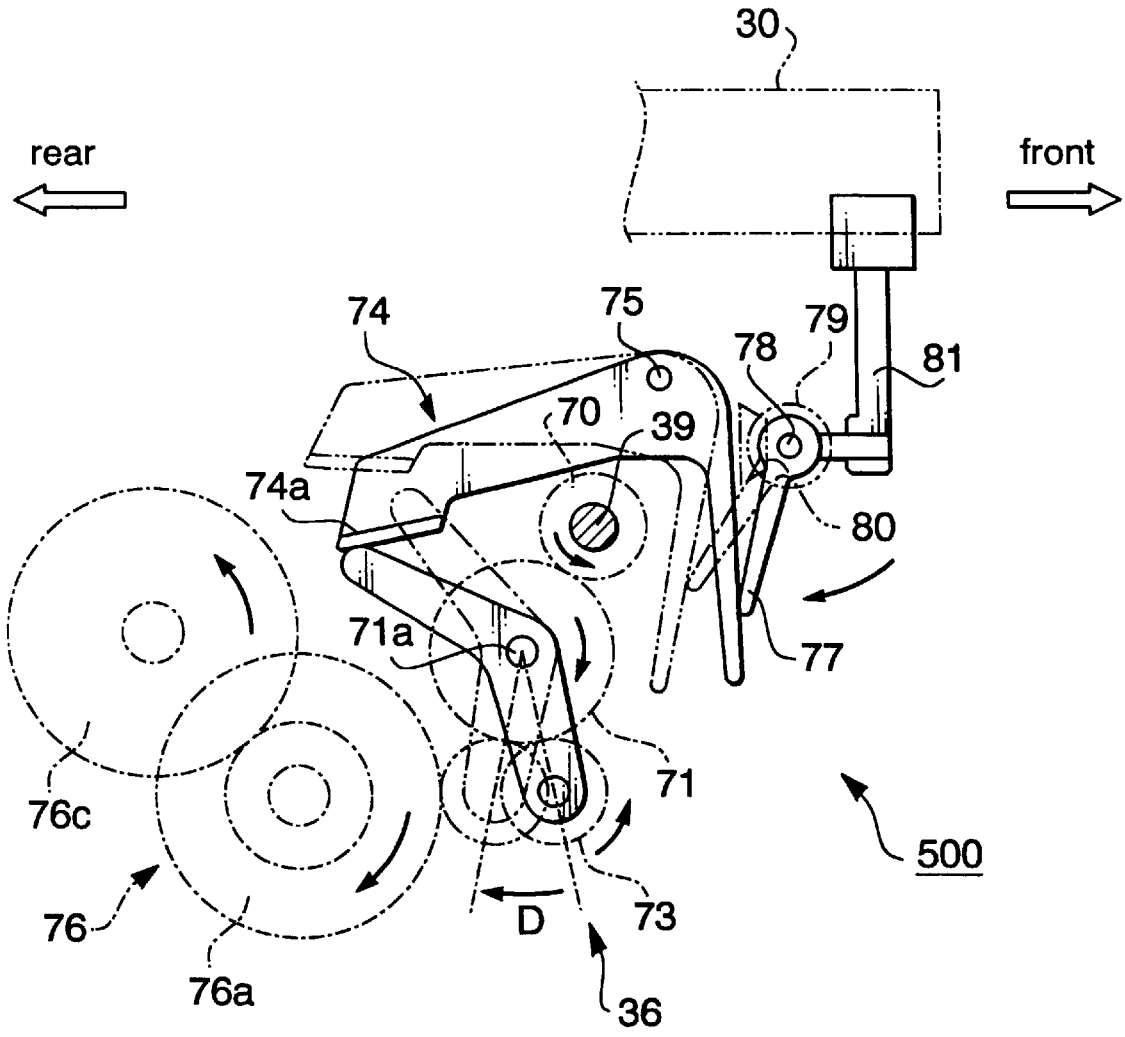
FIG. 14 is a side view of a second clutch of the embodiment.

FIG. 14 is a side view of the second clutch 400. The second clutch 400 includes a planetary gear unit. The planetary gear unit includes a central gear 71 and a pinion 73 meshing with each other. The central gear 71 is rotatably supported by a center shaft 71*a*. The pinion 73 is supported by a rotatable arm 72 which is rotatably supported by the center shaft 71*a*, so that the pinion 73 is able to rotate around the central gear 71. The central gear 71 meshes with the second transmission gear 70 provided to the main shaft 39.

A swing lever 74 is provided above the planetary gear unit. The swing lever 74 is vertically swingable about a shaft 75. The swing lever 74 is swingable between an upper position shown by dash-line in FIG. 14 and a lower position as shown by solid line in FIG. 14. When the swing lever 74 is at its lower position, the swingable lever 74 urges the rotatable arm 72 from above, so that the pinion 73 is moved away from the gear 76*a*. When the swing lever 74 is at its upper position, the swingable lever 74 does not urge the rotatable arm 72.

In order to move the swing lever 74 according to the movement of the print head 30, a contact lever 81 is provided to the vicinity of the swing lever 74, which is to be pushed by the pusher plate 30*a* of the print head 30. The contact lever 81 has a rotation shaft 81*a* at the lower end thereof which is rotatably supported by a not-shown supporting member. The contact lever 81 is swingable between an elected position and an inclined position.

An urging lever 77 is provided between the swing lever 74 and the contact lever 81. The urging lever 77 has a rotation shaft 79*a* at the upper end thereof which is rotatably supported by a not-shown supporting member. Rotation axes of the urging lever 77 and the swing lever 74 are parallel to each other. The urging lever 77 directly urges the swing lever 74 so that the swing lever 74 swings to its upper position. The swinging directions of the urging lever 77 and the contact lever 81 are perpendicular to each other. Thus, bevel gears 79 and 80 are respectively provided to the rotation shafts 79*a* and 81*a*. Due to the engagement of the bevel gears 79 and 80, the swinging of the contact lever 81 is transmitted to the swinging of the urging lever 77.

With such an arrangement, when the print head 30 moves in the maintenance station T2, the contact lever 81 is pushed by the pusher plate 30*a* and inclined. With this, the urging lever 77 swings and urges the swing lever 74 to its upper position. Thus, the swing lever 81 does not urge the rotatable arm 72. In this state, the controller 100 (FIG. 15) drives the main motor 38 (FIG. 7) counterclockwise, so that the gear 70 rotates counterclockwise. With this, the central gear 71 rotates clockwise. Due to the engagement of the central gear 71 and the pinion 73, the pinion 73 moves to an intermediate gear 76*a* as shown by an arrow D in FIG. 12, so that the pinion 73 mesh with the intermediate gear 76*a*. The intermediate gear 76*a* is linked to the spool gear 76*c* via a reduction gear 76*b* which is coaxially provided to the intermediate gear 76*a*. With this, the rotation of the second transmission gear 70 is transmitted to the spool gear 76*c*. That is, the spool 91 (FIG. 13) is rotated. Further, the swing lever 74 is linked to the platen moving mechanism 94 (FIG. 13) via not-shown link system. The platen moving mechanism 94 moves the platen 93 (FIG. 13) toward the ink nozzles 19 when the swing lever 74 is in the upper position. Furthermore, the rotation of the spool gear 76*c* is transmitted to a not-shown air pump. The air pump pressurizes the ink nozzles 19 so that ink droplets are emerged to the roll sheet R. The main motor 38 is rotated counterclockwise for a certain period of time. In this period, ink droplets are emerged from the ink nozzles 19 onto the roll sheet R being carried by the spools 91 and 92. The contamination in the ink nozzles 19 can be discharged. Accordingly, the clogging of the ink nozzles 19 can be prevented and the ink nozzles 19 are cleaned.

When the print head 30 moves out of the maintenance station T2, the contact lever 81 swings back to its elected position. With this, the contact lever 81 urges the rotatable arm 72 downward, so that the pinion 72 is moved away from the intermediate gear 76*a*. Accordingly, the rotation of the second transmission gear 70 is not transmitted to the spool gear 76*c*. In this embodiment, a not-shown stopper is provided for restricting the moving range of the planetary lever 72, in order to limit the moving amount of the pinion 73 in the direction away from the intermediate gear 76*a*.

As described above, the second clutch 400 is connected when the print head 30 is located in the maintenance station T2 and disconnected when the print head 30 is located out of the maintenance station T2.

Figure 15:
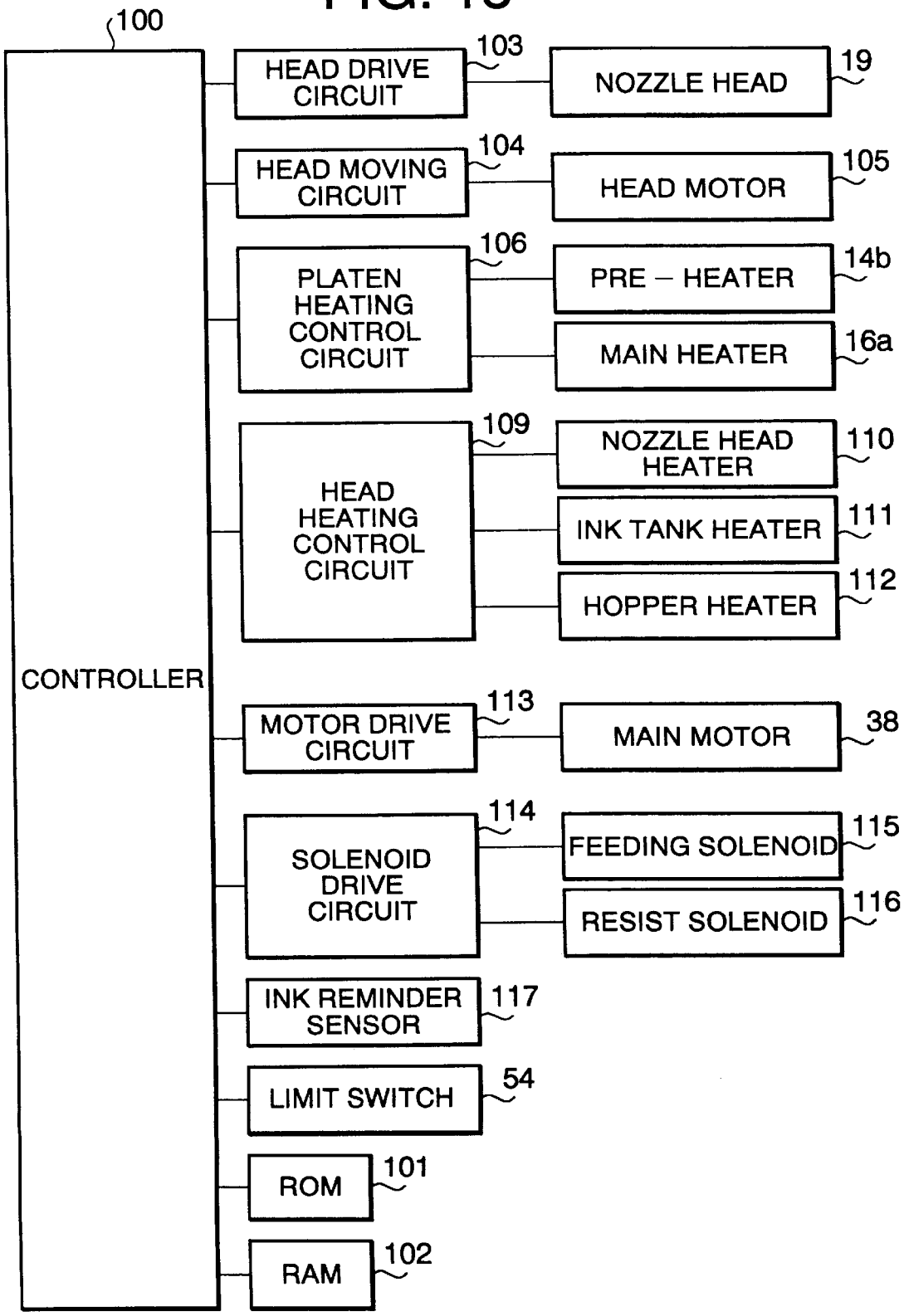
FIG. 15 is a block diagram showing a control system of the printer of FIG. 1.

FIG. 15 is a block diagram showing a control system of the ink jet printer 1. The controller 100 controls a printing operation according to a print data (sent from a computer or the like), based on control programs stored in a ROM 101. The controller 100 is connected to a head drive circuit 103 for controlling the ink nozzles 19 and a head drive circuit 104 for controlling a head drive motor 105 to move the print head 30. Further, the controller 100 is connected to a platen heating control circuit 106 which controls a pre-heater 14*a* of the pre-heat platen 14 and a main heater 15*a* of the main-heat platen 15, so as to keep the platens 14 and 15 to predetermined temperatures. Still further, the controller 100 is connected to a head heating control circuit 109 which controls a ink nozzles heater 110 (for heating the ink nozzles 19), an ink heater 111 (for heating the ink in the ink tank of the print head 30) and a hopper heater 112 (for heating the hoppers 35 to melt the pellets 22 stored therein). Yet further, the controller 100 is connected to a motor drive circuit 113 which controls the main motor 38. Furthermore, the controller 100 is connected to a solenoid driving circuit 114 which controls a sheet feeding solenoid 115 for selectively actuating one of the hemicircular rollers 11*a* and 11*b* and for controlling the resist solenoid 116 for instantly stopping the rotation of the resist roller pair 13*a* and 13*b*. The controller 100 receives detecting signals from an ink reminder sensor 117 for detecting the reminder of the ink in the ink tank. Also, the controller 100 receives detecting signals from the limit switch 54.

When the controller 100 receives a detecting signal indicating the lack of the ink of a certain color from the ink reminder sensor 117, the controller 100 sends indication signals to the head driving circuit 104 and the motor driving circuit 113 so as to supply the pellet 22 of the same color to the corresponding hopper 35 of the print head 30. Further, the controller 100 send indication signals to the head control circuit 109 thereby to drive the hopper heater 112 so that the supplied pellets 22 are rapidly melt in the hopper 35.

On normal printing operation, the controller 100 controls the motor drive circuit 113 to rotate the main motor 38 in a normal direction (clockwise in FIG. 7), so as to rotate the feed roller 15, the resist rollers 13*a* and 13*b* and the discharge roller 18. On supplying ink to the print head 30, the controller 100 controls the motor drive circuit 113 thereby to rotate the main motor 38 in the normal direction and then in the reversed direction so as to operate the supply mechanism 300. On maintenance, the controller 100 controls the motor drive circuit 113 thereby to rotate the main motor 38 in the reversed direction for operating the maintenance system 500.

The ROM 101 stores positional data of the print head 30, required for positioning the print head 30 with respect to the supply mechanism 300 (and the maintenance mechanism 500). In particular case, the position of the print head 30 is detected by counting encoder pulses. In such case, the ROM 101 stores the encoder pulses representing the position of the print head 30 where the supplying operation of the pellets 22 is to be performed. The RAM 102 is used for storing printing data sent from a computer or the like and used for a work area for processing various kind of controls.

According to the embodiment, since the supply mechanism 300 and the maintenance mechanism 500 are actuated by the same motor 38, the number of motors can be reduced. Accordingly, the manufacturing cost of the ink jet printer can be reduced. Further, since the feeding of the recording sheet is also performed by the main motor 38 (as well as the supply mechanism 300 and the maintenance mechanism 500), the number of actuators can be further reduced. Accordingly, the manufacturing cost of the ink jet printer can be further reduced. Furthermore, since each of the first clutch 200 and the second clutch 400 is connected/disconnected by the movement of the print head 30, the control system becomes simple.

Although the structure and operation of an ink jet printer is described herein with respect to the preferred embodiments, many modifications and changes can be made without departing from the spirit and scope of the invention.

What is claimed is:

1. An ink jet printer comprising:

a feeder which feeds a recording media along a feeding path;

a print head having ink nozzles, which is movable in a direction across said feeding path;

a supply station in which said print head is supplied with ink by means of a supply mechanism;

a maintenance station in which a predetermined operation is performed on said print head by means of a maintenance mechanism;

an actuator for driving the supply mechanism and the maintenance mechanism; and a controlling mechanism that causes the actuator to selectively drive the supply mechanism and the maintenance mechanism the controlling mechanism including:

a first clutch which transmits the power of said actuator to said supply mechanism only when said print head is located in said supply station; and a second clutch which transmits the power of said actuator to said maintenance mechanism only when said print head is located in said maintenance station.

2. The ink jet printer according to claim 1, wherein said supply station and said maintenance station are located outside of said feeding path.

3. The ink jet printer according to claim 2, wherein said supply station is provided at one side of said feeding path in said direction, and wherein said maintenance station is provided at the other side of said feeding path in said direction.

4. The ink jet printer according to claim 1, wherein said first clutch is connected due to a movement of said print head when said print head moves into said supply station, and wherein said first clutch is disconnected due to a movement of said print head when said print head moves out of said supply station.

5. The ink jet printer according to claim 4, said first clutch comprising:

a drive member linked to said actuator;

a driven member linked to said supply mechanism;

wherein said drive member is moved with respect to said driven member in response to the movement of said print head, so that said drive member and driven member engage and disengage with each other.

6. The ink jet printer according to claim 5, said first clutch further comprising a biasing member which biases said drive member in a direction toward said driven member, when said print head is located in said supply station.

7. The ink jet printer according to claim 6, wherein said biasing member biases said drive member in a direction away from said driven member, when said print head is located out of said supply station.

8. The ink jet printer according to claim 1, wherein said second clutch is connected due to a movement of said print head when said print head moves into said maintenance station, and wherein said second clutch is disconnected due to a movement of said print head when said print head moves out of said maintenance station.

9. The ink jet printer according to claim 8, said second clutch comprising:

a planetary gear unit including a central gear, a pinion meshing with said central gear and a rotatable arm supporting said pinion;

a drive gear linked to said actuator, said drive gear meshing said central gear;

a driven gear linked to said maintenance mechanism; and an urging mechanism which urges said rotatable arm, wherein said urging mechanism urges said rotatable arm to disable a meshing of said pinion and said driven gear when said print head is located out of said maintenance station, wherein said urging mechanism does not urge said rotatable arm when said print head is located in said maintenance station.

10. The ink jet printer according to claim 9, further comprising a contact lever which is to be pushed by said print head, said contact lever being linked to said urging mechanism.

11. The ink jet printer according to claim 1, wherein said feeder is actuated by said actuator.

12. The ink jet printer according to claim 11, wherein said actuator is rotatable in two directions, wherein said feeder is driven by a rotation of said actuator of one direction, and wherein said maintenance mechanism is driven by a rotation of said actuator of the other direction.

13. The ink jet printer according to claim 12, wherein said supply mechanism is driven by a rotation of said actuator of said one direction and by a rotation of said actuator of said the other direction.

14. The ink jet printer according to claim 1, wherein said ink is obtained by melting solid pellets, and wherein said supply mechanism is arranged to supply said solid pellets to said print head.

15. The ink jet printer according to claim 1, wherein said predetermined operation includes a feeding of a sheet in said maintenance station, so that said recording head is able to emerge ink droplets on said sheet.

16. The ink jet printer according to claim 1, further comprising:

a shaft which is rotated by said actuator;

a roller provided to said shaft; and first and second transmission gears located at both sides of said roller, wherein said first and second transmission gears are linked to said first and second clutches, selectively.

17. An ink jet printer comprising:

a feeder which feeds a recording media along a feeding path;

a print head having ink nozzles, which is movable in a printing path in a direction across said feeding path;

a supply mechanism provided at one side of said feeding path, which supplies ink to said print head;

a maintenance mechanism provided at the other side of said feeding path, which performs a maintenance operation on the print head;

a first clutch which transmits power to said supply mechanism only when said print head is located in said one side;

a second clutch which transmits power to said maintenance mechanism only when said print head is located in said the other side; and at least one of the first and second clutches having a contact mechanism at a predetermined location in the printing path that is selectively contacted during movement of the print head past the predetermined location to place the at least one of the first and second clutches into an activated condition, the at least one of the first and second clutches remaining in the actuated condition after the print head moves out of contact with the contact mechanism but remains within a predetermined range beyond the predetermined location.

18. The ink jet printer according to claim 17, wherein said first clutch is connected due to a movement of said print head when said print head moves into said supply station, and wherein said first clutch is disconnected due to a movement of said print head when said print head moves out of said supply station.

19. The ink jet printer according to claim 17, wherein said second clutch is connected due to a movement of said head when said print head moves into said maintenance station, and wherein said second clutch is disconnected due to a movement of said print head when said print head moves out of an maintenance station.

20. The ink jet printer according to claim 17, wherein said feeder is actuated by said actuator.

21. The ink jet printer of claim 17, wherein the at least one of the first and second clutches is the first clutch.

22. The ink jet printer of claim 21, wherein the first clutch includes a biasing member connected to the contact mechanism to maintain the first clutch in the actuated condition after the print head moves out of contact with the contact mechanism.

23. The ink jet printer of claim 17 wherein a predetermined operation is performed on the print head in accordance with a position of the print head in the predetermined range.

24. The ink jet printer of claim 23 wherein the predetermined operation includes a first operation for selecting one of a plurality of ink heads in the print head, and a second operation for performing one of: (a) supplying ink to the selected ink head; and (b) performing the maintenance operation on the selected ink head.

25. The ink jet printer of claim 24, wherein an ink color to be supplied to the selected ink head is determined by a position of the print head.

* * * * *